US005460442A

United States Patent [19]

Nykanen

[11] Patent Number: 5,460,442

[45] Date of Patent: Oct. 24, 1995

[54] DEVICE FOR USE IN THE SALE OF GROCERIES

[75] Inventor: Pekka Nykanen, Vieremä, Finland

[73] Assignee: Tarja Leinonen, Vierema, Finland

[21] Appl. No.: 290,761

[22] PCT Filed: Feb. 12, 1993

[86] PCT No.: PCT/FI93/00042

§ 371 Date: Aug. 17, 1994

§ 102(e) Date: Aug. 17, 1994

[87] PCT Pub. No.: WO93/16624

PCT Pub. Date: Sep. 2, 1993

[30] Foreign Application Priority Data

Feb. 21, 1992 [FI] Finland ..... 920755

[51] Int. Cl.[6] ..... A47B 95/02

[52] U.S. Cl. ..... 312/319.4; 312/305; 312/117

[58] Field of Search ..... 312/319.4, 305, 312/304, 249.2, 249.8, 3, 4, 117, 42

[56] References Cited

U.S. PATENT DOCUMENTS

| | | | |
|---|---|---|---|
| 568,631 | 9/1896 | Smith | 312/305 X |
| 906,283 | 12/1908 | Pohl | 312/305 X |
| 916,795 | 3/1909 | Shafer | 312/305 X |
| 923,895 | 6/1909 | Emmett et al. . | |
| 984,835 | 2/1911 | Meeks | 312/305 X |
| 1,619,292 | 3/1927 | Cutler | 312/305 X |
| 2,541,185 | 2/1951 | Adams | 312/305 X |
| 3,254,928 | 6/1966 | Clatterbuck | 312/249.2 X |
| 3,575,478 | 4/1971 | Szobski | 312/117 |
| 3,644,009 | 2/1972 | Tyler | 312/117 |
| 3,804,480 | 4/1974 | Chamberlin | 312/117 |
| 4,657,139 | 4/1987 | Hanifl | 220/336 |
| 5,013,102 | 5/1991 | Loblein | 312/305 X |

*Primary Examiner*—Kenneth J. Dorner
*Assistant Examiner*—Rodney B. White
*Attorney, Agent, or Firm*—Cushman, Darby & Cushman

[57] ABSTRACT

A device to be used in the sale of groceries including a side (1) made at least in part of transparent material and behind which groceries are to be placed and which is equipped with openings (2) through which the groceries are taken from inside the device. For hygienic reasons,groceries that are sold loose cannot be kept on open shelves. The device according to the invention has a plate (4) equipped with openings (3) which has been fastened to the front of the side so it can revolve, and these openings (3) have been arranged to turn to the front of the openings (2) of the side when groceries are to be taken from the device.

10 Claims, 1 Drawing Sheet

DEVICE FOR USE IN THE SALE OF GROCERIES

BACKGROUND OF THE INVENTION

1. Field of the Invention

The object of the invention is a device to be used in the sale of groceries, especially pastries or similar groceries. This device comprises a side, made at least in part of transparent material, behind which groceries can be placed, this side being fitted with openings through which the groceries are taken from inside the device.

2. Related Art

When different kinds of groceries are sold loose as, for instance pastries, they are usually placed on the shelves behind a transparent plate so that the customers can see them but the salespeople take the products from the shelf at the customers' request and wrap them up in bags or other packages. A special worker is needed for this job, which increases costs. Some products are sold as self-service so that customers take them from trays or other such things. Pastries and similar products cannot be kept in an open space facing the store for hygienic reasons because in an open space they would be exposed to dust, saliva and other forms of uncleanliness or could be damaged.

SUMMARY OF THE INVENTION

The aim of the invention is to bring forward a device to be used in the sale of groceries and especially pastries, and with this device the disadvantages connected with present devices can be avoided. More precisely, the aim of the invention is to bring forward a device which is hygienic and, when it is in use, allow customers themselves can take the products they wish from the device. In addition, the aim of the invention is to bring forward a device which is simple in structure, reliable and easy to use and which saves labor costs.

The device according to the invention comprises a plate equipped with openings which has been fastened to the front of the side so that it can freely revolve, these openings have been arranged to turn to the front of the openings of the side when groceries are taken from the device. Groceries are brought to the device and placed, for example, in their tray onto the shelves of the device or against supports so that the groceries coincide with the openings of the side. When the device is not in use, the plate is turned in such a way that its openings do not coincide with the openings of the side. In this case, the plate covers the openings of the side and the groceries are behind the plate sheltered from dust, saliva and other uncleanliness. When a customer wishes to take some grocery from the device, the plate turns as a result of the customer's actions so that the openings of both the side and the plate coincide and the customer is able to take the grocery of his/her choice from the device. The device is suitable for all kinds of groceries and especially for pastries or similar fresh groceries.

In a favorable embodiment of the invention, one half of the plate is heavier than the other half with respect to the shaft of the plate. In this case, the plate turns freely to a certain position. The plate can, in some embodiments, be for example fastened eccentrically to the shaft whereas in other embodiments a weight can be connected to one half of the plate or it can be made of heavier or thicker material than the other half. The difference in weights need not be great; it is enough that the plate is able to turn.

The turning movement of the plate can be favorably restricted by a restricting device which is fastened to the side or alternatively to the plate. In this case, a corresponding counterpart to the restrictor has been made on the plate or correspondingly on the side of the device for restricting the movement of the restricting device. The shape and structure of the restricting device and its counterpart may vary considerably in different embodiments of the invention.

In a favorable additional embodiment of the invention a support has been made onto the plate for the tongs of the groceries. The support has been placed on the lighter part of the plate so that due to the weight of the tongs, the plate has been arranged to turn into such a position that the openings of the side and the plate do not coincide. Thus the groceries are sheltered behind the plate. When a customer takes the tongs off from the support, the plate will turn, weighed down by the heavier part of the plate, into such a position that the openings coincide. After this, the customer is able to take groceries through the openings from inside the device.

BRIEF DESCRIPTION OF THE DRAWING

In the following, the invention will be explained in more detail by referring to the attached drawing in which.

Figure 3:
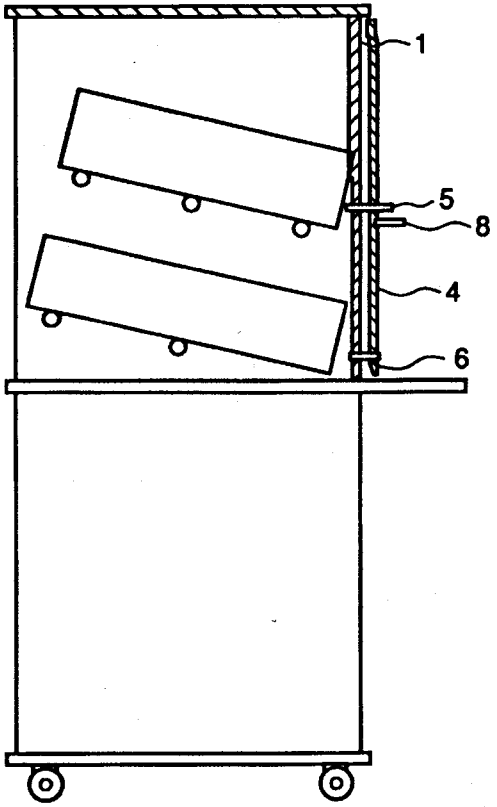
FIG. 3 shows a side view of the device according to FIG. 1.

The device according to the figures has a frame shaped like a cupboard. On the front part of the frame a side 1 has been made of transparent material and openings 2 have been made therein. A round plate 4 has been fastened to the side so that it can revolve, and the plate is equipped with openings 3 which match the openings 2 of the side 1 in size. The plate has been fastened to the side by an eccentrically placed shaft 5. The shaft has been placed eccentrically so that one half of the plate is slightly heavier than the other half. A pivot 6 which acts as a restricting device has been fastened to the plate 4. This pivot has been arranged to reach inside the device. In this place on the side 1, a furrow 7 has been made which acts as a counterpart in which the pivot is able to move within certain limits when the plate is turning. On the other edge of the plate, a support 8 has been made which reaches outside of the plate, and this support is for the tongs for taking the groceries or for a corresponding weight.

Figure 2:
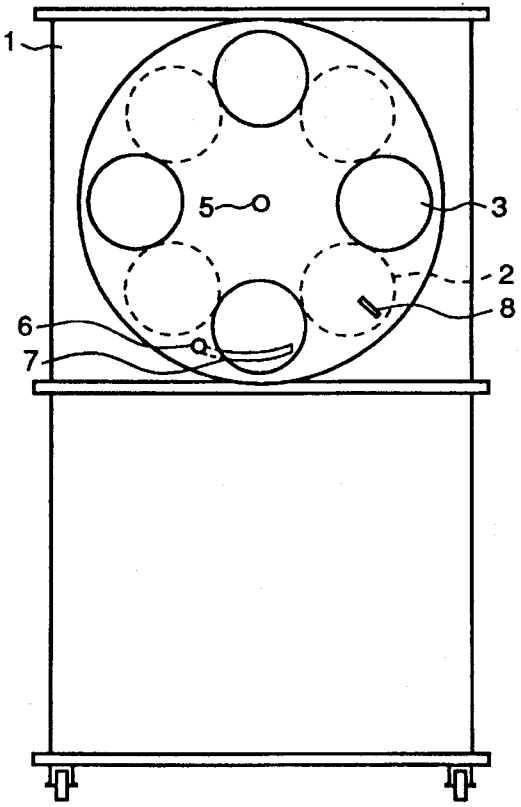
FIG. 2 shows a front view of the device according to FIG. 1 in a closed-position.
Figure 1:
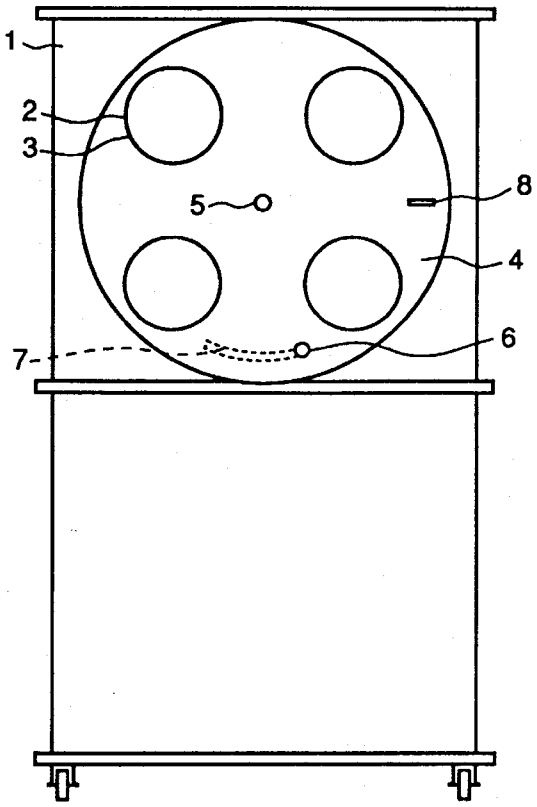
FIG. 1 shows a front view of an embodiment of a device used in the sale of groceries according to the invention in an open-position.

When the device is in use, the groceries are put into the device for example in trays through its back part and the trays or equivalent are placed against the supports in a slanting position. In this way, the groceries coincide with the openings of the side of the device. When the tongs are resting on the support, they are pressing the plate down and the plate is turned into a closed-position shown in FIG. 2. In this case, the pivot is pressed against one end of the furrow. When a customer comes to the device he/she takes the tongs in his/her hand and then the heavier half of the plate turns downwards and simultaneously the openings turn to coincide with each other and the customer can take the groceries of his/her choice through the openings. In this open-position the pivot is pressed against the other end of the furrow. When the customer places the tongs back in their place the plate turns into a closed-position and this stops unhygienic matter from getting into the device.

The invention will not be limited to the described favorable embodiment, but rather the present invention is intended to include all modifications and alternative arrangement included within the spirit and scope of the appended claims.

I claim:

1. A device for displaying and allowing access to objects, said device comprising:

a side made at least in part of transparent material and behind which the objects are to be placed, the side being equipped with openings through which the objects are taken from inside the device, wherein the device has a plate equipped with openings which has been fastened to the side so it can revolve, and the openings of the plate are adapted to revolve into alignment with the openings of the side when objects are taken from the device.

2. A device according to claim 1, wherein said plate is coupled to the side via a shaft; and wherein one half of the plate is heavier than the other half with respect to the shaft.

3. A device according to claim 2 wherein a support is coupled to the plate and the support is disposed on the lighter half of the plate so that due to the weight of an object supported by the support, the plate turns into such a position where the openings of the side and of the plate do not coincide.

4. A device according to claim 2 wherein the plate is fastened eccentrically to the side with a shaft.

5. A device according to claim 2 wherein the heavier half of the plate includes weights.

6. A device according to claim 1 wherein the device has a restricting device fastened to at least one of the side and the plate for restricting movement of the plate.

7. A device according to claim 6, wherein the device includes a counterpart that interacts with the restricting device, said counterpart restricting the movement of the restricting device.

8. A device for displaying and allowing access to objects, comprising:

a three dimensional container having at least one side wall at least partially formed from a transparent material, said side wall having openings therein;

a rotatable plate rotatably connected to said side wall, said plate having openings formed therein;

wherein said plate is rotatable so that said openings of said side wall may be aligned with said openings of said plate to allow access to said objects.

9. A device according to claim 8, further comprising a restricting means for limiting movement of said plate.

10. A device according to claim 8, further comprising a support for a weight wherein when the weight is disposed on said support, said plate will rotate so that said openings of said side wall are not aligned with said openings of said plate.

* * * * *